US011649137B2

(12) United States Patent
Marvin et al.

(10) Patent No.: US 11,649,137 B2
(45) Date of Patent: May 16, 2023

(54) ELEVATOR SOUND SYSTEMS

(71) Applicant: Otis Elevator Company, Farmington, CT (US)

(72) Inventors: Daryl J. Marvin, Farmington, CT (US); Laurent Coldre, Nibelle (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 1297 days.

(21) Appl. No.: 16/114,496

(22) Filed: Aug. 28, 2018

(65) Prior Publication Data

US 2019/0071280 A1 Mar. 7, 2019

(30) Foreign Application Priority Data

Sep. 7, 2017 (EP) ..... 17306155

(51) Int. Cl.
*B66B 3/02* (2006.01)
*B66B 3/00* (2006.01)
(Continued)

(52) U.S. Cl.
CPC ..... *B66B 3/023* (2013.01); *B66B 3/002* (2013.01); *B66B 11/026* (2013.01);
(Continued)

(58) Field of Classification Search
CPC ..... B66B 3/023; B66B 3/002; B66B 11/0226; B66B 11/026; H04R 1/028; H04R 27/02; H04R 2201/021; H04R 3/00
See application file for complete search history.

(56) References Cited

U.S. PATENT DOCUMENTS 5,042,621 A 8/1991 Ovaska et al.
5,460,570 A 10/1995 Okamura et al.
(Continued)

FOREIGN PATENT DOCUMENTS

CN 101580198 A 11/2009
CN 102190229 A 9/2011
(Continued)

OTHER PUBLICATIONS

"Application of Active Noise Control to an Elevator Cabin"; Landaluze et al., 15th Triennial World Congress, Barcelona, Spain, 2002, 6 pages.
(Continued)

*Primary Examiner* — Jeffrey Donels
(74) *Attorney, Agent, or Firm* — Cantor Colburn LLP

(57) ABSTRACT

Elevator systems including an elevator car moveable within an elevator shaft, the elevator car having a first elevator car component, the first elevator car component having a first side facing an interior of the elevator car and a second side opposite from the first side and a structural sound-generation system. The structural sound-generation system having at least one audio actuator coupled to the second side of the first elevator car component and an audio system controller in communication with the at least one audio actuator. The structural sound-generation system is configured to generate vibrations within the first elevator car component such that sound waves are produced therefrom and projected into the interior of the elevator car.

10 Claims, 5 Drawing Sheets

(51) Int. Cl.

| | |
|---|---|
| ***H04R 1/02*** | (2006.01) |
| ***B66B 11/02*** | (2006.01) |
| ***H04R 27/02*** | (2006.01) |

(52) U.S. Cl.
CPC ..... *B66B 11/0226* (2013.01); *H04R 1/028* (2013.01); *H04R 27/02* (2013.01); *H04R 2201/021* (2013.01)

(56) References Cited

U.S. PATENT DOCUMENTS

| | | | | |
|---|---|---|---|---|
| 5,551,533 | A * | 9/1996 | Ng | B66B 3/00 187/390 |
| 5,699,437 | A | 12/1997 | Finn | |
| 7,905,332 | B2 | 3/2011 | Jayachandran | |
| 8,418,815 | B2 | 4/2013 | Carreno et al. | |
| 8,972,251 | B2 | 3/2015 | Kiang et al. | |
| 9,004,231 | B2 | 4/2015 | Weinberger | |
| 9,309,089 | B2 | 4/2016 | Annen et al. | |
| 9,556,002 | B2 | 1/2017 | Wilke | |
| 2015/0146896 | A1 * | 5/2015 | Pahkala | H04R 19/00 381/191 |
| 2015/0353322 | A1 | 12/2015 | Roivainen et al. | |
| 2016/0214833 | A1 | 7/2016 | Kattainen et al. | |
| 2019/0152747 | A1 * | 5/2019 | Singaraju | B66B 3/002 |
| 2019/0394548 | A1 * | 12/2019 | Stranieri | B66B 1/46 |

FOREIGN PATENT DOCUMENTS

| | | | |
|---|---|---|---|
| CN | 102992129 | A | 3/2013 |
| CN | 103903585 | A | 7/2014 |
| CN | 103303758 | | 1/2016 |
| CN | 106060455 | A | 10/2016 |
| CN | 106144798 | A | 11/2016 |
| JP | 2001058768 | A | 3/2001 |
| JP | 2001278562 | A | 10/2001 |
| JP | 2007223750 | A | 9/2007 |
| JP | 2008024420 | A | 2/2008 |
| JP | 2010222127 | A | 10/2010 |
| JP | 2011037525 | A | 2/2011 |
| JP | 2013049546 | A | 3/2013 |
| JP | 2014019530 | A | 2/2014 |
| JP | 2016023000 | A | 2/2016 |
| JP | 2016071099 | A | 5/2016 |
| WO | 2006019167 | A1 | 2/2006 |
| WO | 2010033103 | A1 | 3/2010 |
| WO | WO-2014027143 | A1 * | 2/2014 ..... B66B 3/00 |

OTHER PUBLICATIONS

European Search Report, European Application No. 17306155.7, dated Mar. 2, 2018, European Patent Office; European Search Report 8 pages.

European Office Action for European Application No. 17306155.7, International Filing Date Sep. 7, 2017, dated May 15, 2020, 7 pages.

European Office Action for European Application No. 17306155.7, International Filing Date Sep. 7, 2017, dated May 25, 2021, 15 pages.

* cited by examiner

ELEVATOR SOUND SYSTEMS

CROSS REFERENCE TO RELATED APPLICATIONS

This application claims the benefit of European Application No. 17306155.7, filed Sep. 7, 2017, which is incorporated herein by reference in its entirety.

BACKGROUND

The subject matter disclosed herein generally relates to elevator systems and, more particularly, elevator sound systems.

Elevator cars typically have sound systems installed therein to provide music, information, or other auditory information to passengers within the elevator cars. However, such systems may not be particularly pleasing to customers. Further, entering and exiting elevator cars can be difficult for persons with disabilities, such as being sight impaired, or for persons carrying large objects. Such persons may enter an elevator car and upon arriving at a landing may not know which elevator car door opens so that they can exit (e.g., an elevator car with front and rear elevator car doors). Thus, when the elevator car doors open at a landing (e.g., the passenger's destination floor), the passenger may not be able to tell which direction they should walk to exit the elevator car. It may be advantageous to provide improved sound systems for passengers within an elevator car.

SUMMARY

According to some embodiments, elevator systems are provided. The elevator system includes an elevator car moveable within an elevator shaft, the elevator car having a first elevator car component, the first elevator car component having a first side facing an interior of the elevator car and a second side opposite from the first side and a structural sound-generation system. The structural sound-generation system includes at least one audio actuator coupled to the second side of the first elevator car component and an audio system controller in communication with the at least one audio actuator. The structural sound-generation system is configured to generate vibrations within the first elevator car component such that sound waves are produced therefrom and projected into the interior of the elevator car.

In addition to one or more of the features described herein, or as an alternative, further embodiments of the elevator systems may include a second elevator car component having a respective first side facing the interior of the elevator car and a respective second side opposite from the first side of the second elevator car component and the structural sound-generation system includes at least one second audio actuator coupled to the second elevator car component and arranged to generate vibrations within the second elevator car component such that sound waves are produced therefrom and projected into the interior of the elevator car.

In addition to one or more of the features described herein, or as an alternative, further embodiments of the elevator systems may include that the first elevator car component is one of an elevator car wall panel, an elevator car frame element, an elevator car support element, an elevator ceiling panel, an elevator floor panel, an elevator car operating panel, or an elevator car door.

In addition to one or more of the features described herein, or as an alternative, further embodiments of the elevator systems may include that the at least one audio actuator coupled to the second side of the first elevator car component comprises a plurality of audio actuators.

In addition to one or more of the features described herein, or as an alternative, further embodiments of the elevator systems may include that the first elevator car component is composed of plastic, metal, glass, or wood.

In addition to one or more of the features described herein, or as an alternative, further embodiments of the elevator systems may include that the audio system controller controls the at least one audio actuator to generate sound within the interior of the elevator car in response to a triggering event.

In addition to one or more of the features described herein, or as an alternative, further embodiments of the elevator systems may include that the triggering event is at least one of an opening of elevator car doors, destination input by a passenger at a car operating panel, arrival at a destination floor, or an emergency announcement.

In addition to one or more of the features described herein, or as an alternative, further embodiments of the elevator systems may include an elevator controller wherein the audio system controller is in communication with the elevator controller to receive information therefrom.

In addition to one or more of the features described herein, or as an alternative, further embodiments of the elevator systems may include a spectral analysis device located within the interior of the elevator car and configured to enable tuning of the structural sound-generation system.

In addition to one or more of the features described herein, or as an alternative, further embodiments of the elevator systems may include that the structural sound-generation system comprises a plurality of audio actuators arranged around the elevator car.

In addition to one or more of the features described herein, or as an alternative, further embodiments of the elevator systems may include that the audio system controller controls the plurality of audio actuators to generate sounds at specific locations within the interior of the elevator car by controlling vibration from the plurality of audio actuators to a plurality of different elevator car components.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
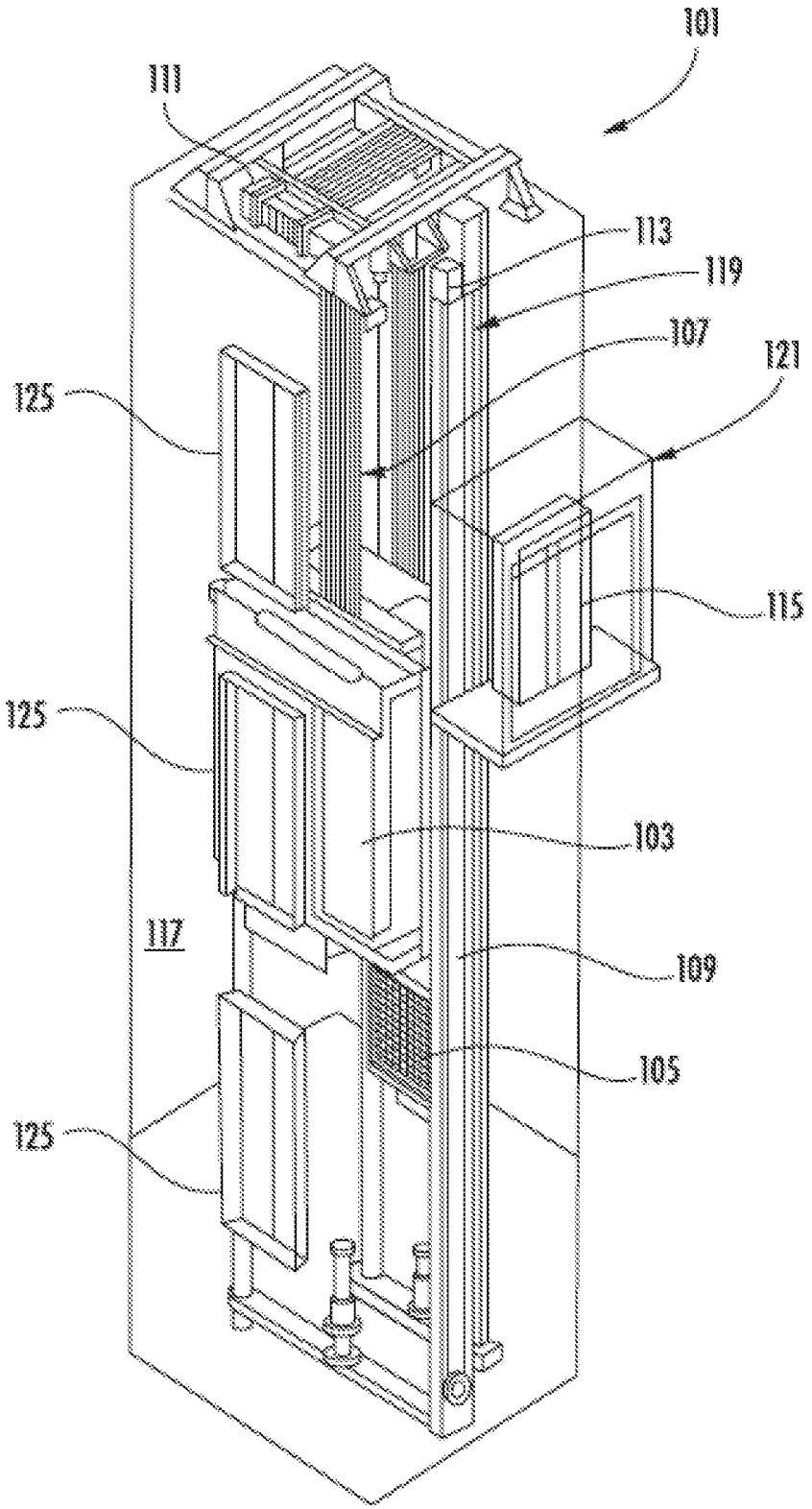
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Elevator systems are typically installed such that various sounds of the systems are minimized within the elevator car, for example, to dampen or otherwise minimize mechanical sounds within the elevator car. Further, elevator cars typically include one or more speakers to provide notifications to passengers within the car. Such speakers may not provide high quality sound to the passenger. Further, elevator systems can instill anxious feelings into passenger due to numerous factors, including enclosed small space, noises, etc. Sound quality (e.g., reverberation, frequency, amplitude, clear sounds, operating noises, spoken information, etc.) within an elevator car may not be compatible with a robust quality perception, particularly in light of a poor passenger experience. Accordingly, embodiments of the present disclosure are directed to providing improved sound quality within elevator cars.

Embodiments of the present disclosure are directed to providing an immersive sound experience within an elevator car. Further, various embodiments of the present disclosure are directed to commissioning systems and processes for immersive elevator system systems. In some embodiments, the structure of the elevator car is employed to generate an immersive sound experience in the elevator car or occupancy/passenger space. That is, the actual elevator car components of the elevator are used for the generation of vibration/sound. The elevator car components include, but are not limited to wall panels, elevator car frame elements, rails, operating panels, floor and/or ceiling panels, elevator car doors, etc. To provide a well-tuned system, each installation (commissioning) must address variables due to different elevator car constructions and other installation variations (e.g., materials, guide rail features, number of floors, etc.). These variations can cause a difference in the sound quality, and thus the immersive sound experience system must be adjusted for best performance.

Embodiments of the present disclosure are directed to structural sound-generation systems. For example, by placing actuators on walls, frame elements, panels, etc., of an interior of an elevator car, a very high quality of sound and/or customization thereof can be provided. The structural sound-generation system may be interfaced with the elevator car such that events of operation of the elevator car (e.g., door openings, chosen level, building ambiance, etc.) can be announced using the structural sound-generation system. Further, because elevator cars are typically made of various different materials, the different materials can be actuated to generate different sounds and/or quality of sounds. For example, different kinds of materials can be used to achieve specific auditory objectives (e.g., plastics for generation of a "human voice," metal for both deep and high sounds, etc.). The audio actuators of the present disclosure can be coupled to one or more elevator car components to enable the generation of sound and/or noise. Elevator car components of the elevator car that can be coupled to audio actuators, in accordance with embodiments of the present disclosure, may include, but are not limited to, car wall panels, car frame and support elements, ceiling and/or floor panels or structures, car operating panels, elevator car doors, elevator car rails, etc.

Figure 2B:
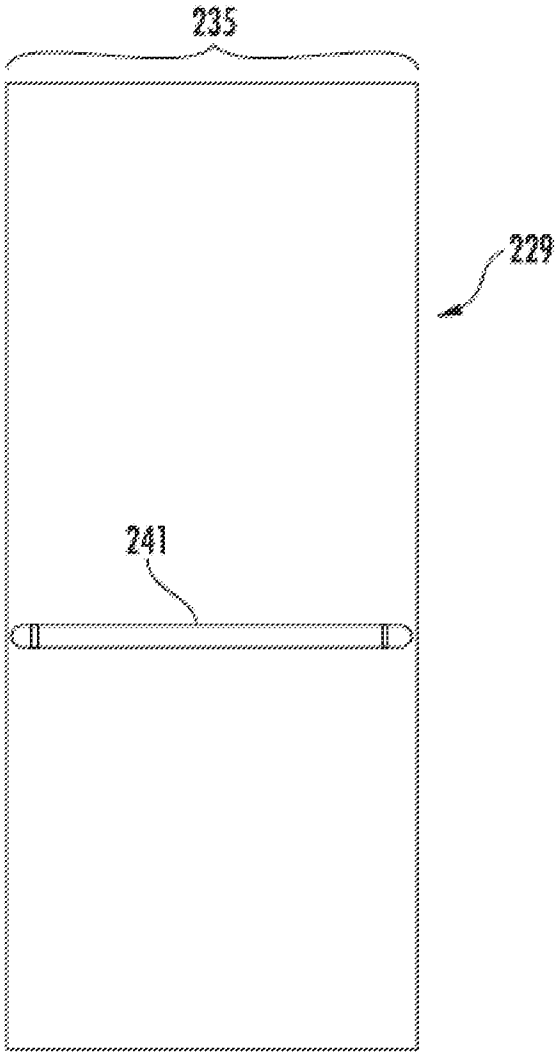
FIG. 2B is an elevation schematic illustration of another elevator car wall panel that can employ embodiments disclosed herein.
Figure 2A:
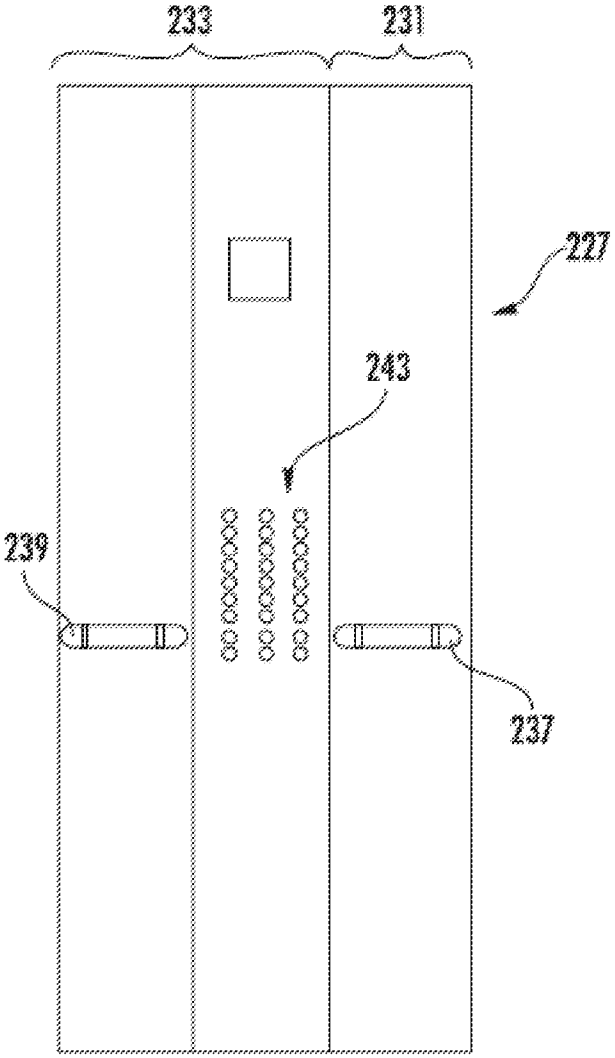
FIG. 2A is an elevation schematic illustration of an elevator car wall panel that can employ embodiments disclosed herein.

Turning now to FIGS. 2A and 2B, schematic illustrations of elevator car wall panels 227, 229 that can employ embodiments described herein are shown. FIG. 2A shows a front elevation schematic view of a first elevator car wall panel 227. FIG. 2B shows a front elevation schematic view of a second elevator car wall panel 229. The first elevator car wall panel 227, as shown, includes two subpanels 231, 233, wherein a first subpanel 231 forms about a third of the elevator car wall panel 227 and the second subpanel 233 forms about two-thirds of the elevator car wall panel 227. The first subpanel 231 and the second subpanel 233 are configured to form a wall of an elevator car. The two subpanels 231, 233, in some configurations, are parts of a solid or continuous elevator car wall panel, and thus are fixedly connected or are subparts of a continuous wall. The second elevator car wall panel 229, as shown, is formed as a single subpanel 235.

As shown, the first subpanel 231 of the first elevator car wall panel 227 includes an associated first handrail 237 and the second subpanel 233 includes an associated second handrail 239. The second elevator car wall panel 229 includes a third handrail 241. The handrails 237, 239, 241 are mounted to the respective subpanels 231, 233, 235 of the elevator car wall panels 227, 229 and provide users or passengers of the elevator to have a handrail to provide support or other function. Accordingly, ends of the handrails 237, 239, 241 are fixedly attached to, mounted to, and supported by the respective subpanels 231, 233, 235. Further, as shown, the second subpanel 233 of the first elevator car wall panel 227 includes an operation or control section such as a car operating panel 243. The car operating panel 243, as shown, includes a number of buttons that are used to enable a passenger to select a destination floor, and may also include emergency buttons, or other buttons as known in the art.

The elevator car wall panels 227, 229 may be elevator car elevator car components as provided herein. Each of the elevator car wall panels 227, 229 and/or the subpanels 231, 233, 235 can have a respective coupled audio actuator arranged to generate vibrations within the associated panel/subpanel. Such vibrations may be configured to produce auditory sounds from the respective panel/subpanel, with such sound generated within an interior of an elevator car (e.g., occupancy space or elevator cab).

Figure 3:
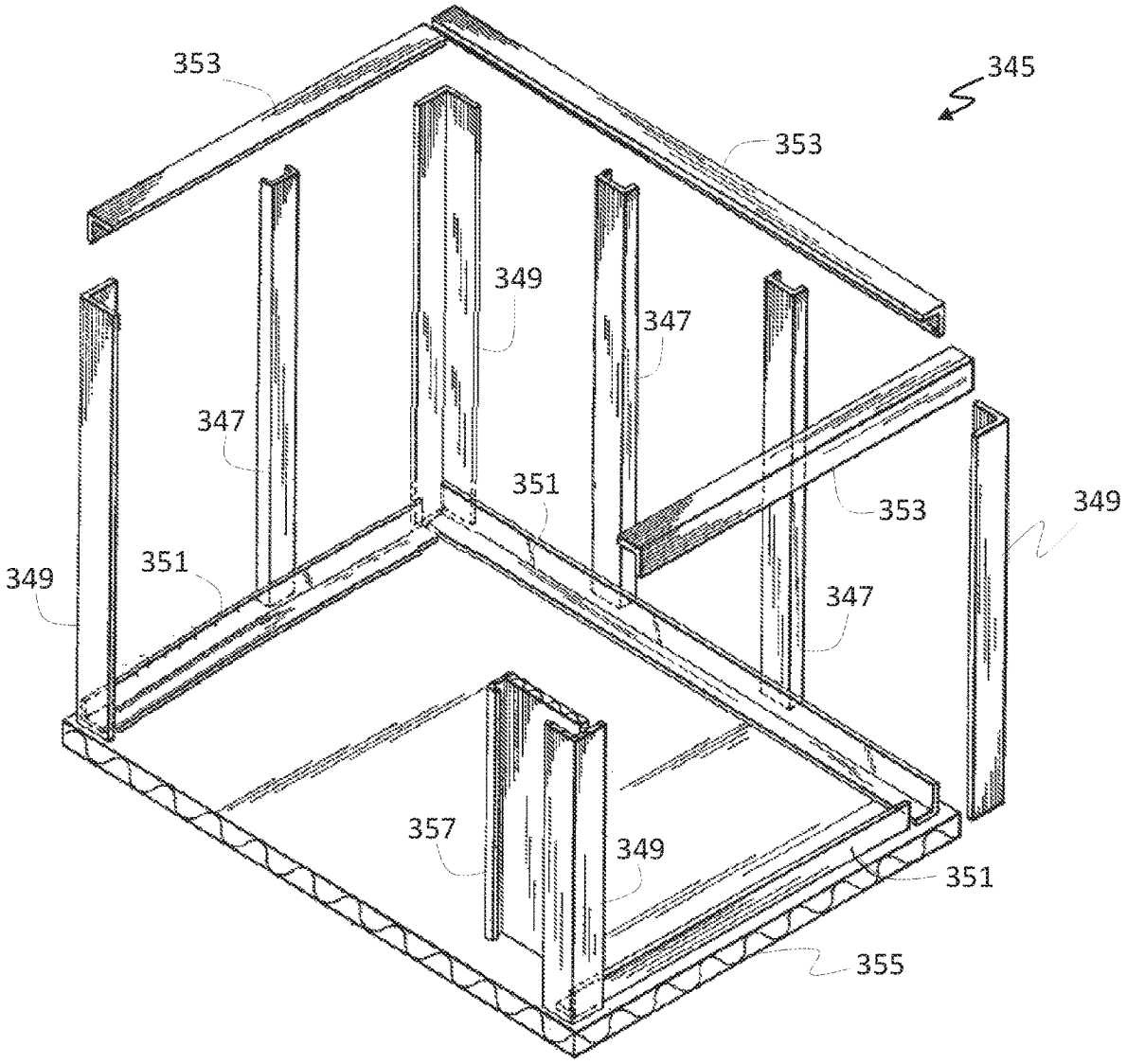
FIG. 3 is an exploded schematic illustration of a frame of an elevator car.

Referring now to FIG. 3, an exploded schematic illustration of a frame 345 of an elevator car is shown, with the elements thereof being elevator car components that may be coupled to audio actuators, as described herein. As shown, the elevator car frame 345 is constructed from a plurality of interconnected frame sections or supports 347, 349, 351, 353 which provide a basic skeleton or frame for the elevator car. In the example embodiment of FIG. 3, wall supports 347 are C-shaped or channeled and spaced between corner supports 349, which are L-shaped. The wall supports 347 and the corner supports 349 are configured to be vertical supports of the elevator car frame 345 and components installed thereto. The wall supports 347 and the corner supports 349 are attached to L-shaped horizontal floor supports 351 and L-shaped horizontal ceiling supports 353. The floor supports 351 may be attached to a floor section 355 and the ceiling supports 353 may be attached to a ceiling section (not shown). Attachment between the supports 347, 349, 351, 353 and/or between a support 347, 349, 351, 353 and the floor section 355 or the ceiling section may be by means of bolting, riveting, welding, or other fastening or attachment means or mechanism.

Additional vertical entrance supports 357 may be configured to define an entranceway to the elevator car. The entrance supports 357 may be C-shaped and may be configured to support, in part, an elevator door and/or mechanisms thereof. As will be appreciated by those of skill in the art, certain horizontal and vertical supports are not shown in the drawing so that other parts of the cabin frame may be illustrated.

In some elevator car constructions, the frame 345 will be connected and formed. Subsequently, elevator car wall panels (e.g., as shown in FIGS. 2A-2B) will be affixed to the supports 347, 349, 351, 353 of the frame 345. Handrails and/or other features may then be affixed to the elevator car wall panels and/or may be affixed through the elevator car wall panels to the frame 345. Those of skill in the art will appreciate that the supports and other features of the frame 345 of FIG. 3 are merely provided as an example of an elevator cabin frame and frames of elevator cars may take different configurations and/or the parts thereof (e.g., the configurations of the supports) may vary without departing from the scope of the present disclosure.

Figure 4:
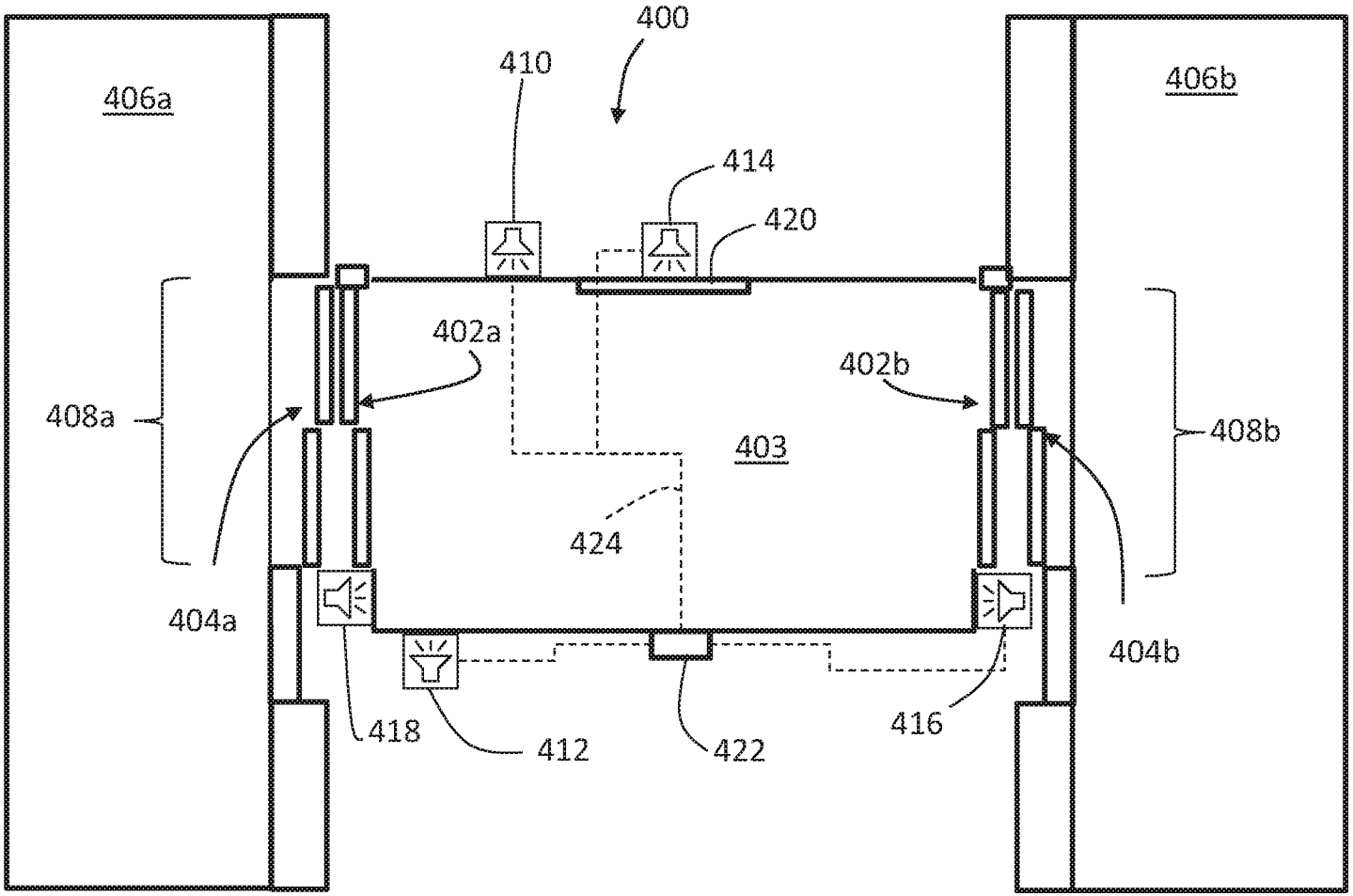
FIG. 4 is a schematic illustration of an elevator car having a structural sound-generation system installed in accordance with an embodiment of the present disclosure.

Turning now to FIG. 4, a schematic illustration of an elevator car 403 having a structural sound-generation system 400 installed therein is shown. As shown, the elevator car 403 has first and second elevator car doors 402*a*, 402*b* at first and second sides which align with first and second landing doors 404*a*, 404*b* at a landing (indicated as first side 406*a* and second side 406*b*). The first elevator car doors 402*a* and the first landing doors 404*a* define a first entrance 408*a* at the first side 406*a* of the landing. Similarly, the second elevator car doors 402*a* and the second landing doors 404*b* define a second entrance 408*b* at the second side 406*b* of the landing. The structural sound-generation system 400 includes a plurality of audio actuators 410, 412, 414, 416, 418 installed at various locations around the elevator car 403.

The audio actuators 410, 412, 414, 416, 418 of the structural sound-generation system 400 are coupled to various elevator car components (e.g., elevator car frame elements, elevator car support elements, elevator car wall panels, etc.). The audio actuators 410, 412, 414, 416, 418 are arranged to generate audio output to provide personalized voice indications or auditory instructions and/or sounds to safely guide and orient passengers within the elevator car 403. Although shown with an elevator car 403 having first and second entrances 408*a*, 408*b*, those of skill in the art will appreciate that embodiments described herein can be employed in elevator cars that have any number of entrances, including single entrance elevator cars. As shown, a first audio actuator 410 is coupled to a side wall of the elevator car 403, a second audio actuator 412 is coupled to an opposing side wall of the elevator car 403, a third audio actuator 414 is coupled to a car operating panel 420, a fourth audio actuator 416 is coupled to an elevator car door wall panel, and a fifth audio actuator 418 is coupled to an opposing elevator car door wall panel. Although shown with five audio actuators coupled to example elevator car components, those of skill in the art will appreciate that any number of audio actuators may be employed in accordance with the present disclosure and may be coupled to any structural or aesthetic element of an elevator car, and FIG. 4 is provided merely for illustrative purposes.

The structural sound-generation system 400 includes an audio system controller 422 that is in communication with the audio actuators 410, 412, 414, 416, 418. As shown, a communication connection 424 is established between the audio system controller 422 and the audio actuators 410, 412, 414, 416, 418. The communication connection 424 may be a wired and/or wireless communication connection using any known communication protocols and/or techniques. The audio system controller 422 includes various electrical components, including, but not limited to, a processor, memory, electrical buses, communication components, etc. The audio system controller 422 controls output or vibration generation of the audio actuators 410, 412, 414, 416, 418 in accordance with embodiments of the present disclosure.

As described herein, the audio system controller 422 is configured to control one or more of the audio actuators 410, 412, 414, 416, 418 to generate vibrations to in turn generate an audio output from a coupled elevator car component. The audio system controller 422 can control the specific output from the audio actuators 410, 412, 414, 416, 418 and associated elevator car components (e.g., synthesized voice communications/instructions, sounds, audio indicators, etc.). In some embodiments, the audio system controller 422 can be integrated into the car operating panel 420 or may be integrated and/or part of other electronics and/or control systems associated with the elevator car 403 or corresponding elevator system. In other embodiments, the audio system controller 422 can be mounted onto an exterior of the elevator car 403 as a discrete device.

In one non-limiting example, the audio system controller 422 is configured to control one or more of the audio actuators 410, 412, 414, 416, 418 to provide audio indications regarding which elevator car doors (i.e., elevator car doors 402*a*, 402*b*) will open at a landing (i.e., sides 406*a*, 406*b* of the landing) and/or provide other audio indicator as will be appreciated by those of skill in the art. In some embodiments, the audio actuators 410, 412, 414, 416, 418 may be installed outside of the elevator car 403 and/or in or on elevator car components (e.g., elevator car side panels and/or framing).

Figure 5:
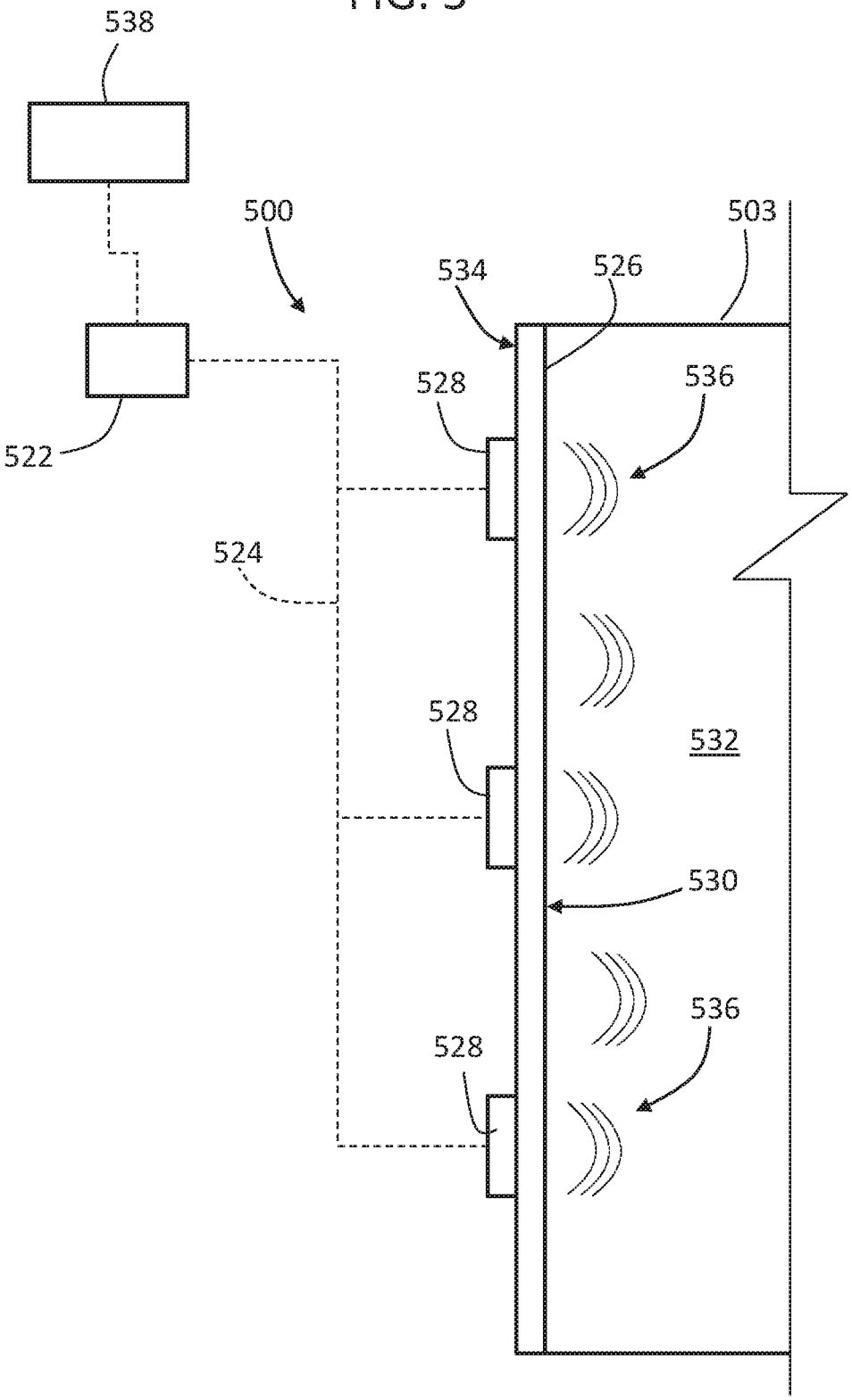
FIG. 5 is a schematic illustration of a portion of a structural sound-generation system in accordance with an embodiment of the present disclosure.

Turning now to FIG. 5, a schematic illustration of an elevator car component 526 having a plurality of audio actuators 528 of a portion of a structural sound-generation system 500 is shown. The elevator car component 526 is a structural or aesthetic element of an elevator car, such as an elevator car wall panel, frame element, support element, car operating panel, etc. The elevator car component 526 has a first side 530 that faces an interior 532 of an elevator car 503 (e.g., a passenger compartment or cab) and a second side 534 that is external to the interior 532 of the elevator car 503 (e.g., a back side and/or exterior side of the elevator car component 526).

As shown, the audio actuators 528 are distributed along the second side 534 of the elevator car component 526 and are coupled to the second side 534 and/or a portion of the elevator car component 526. The audio actuators 528 are fixed to the second side 534 of the elevator car component 526 by any known means, including, but not limited to, fasteners, welding, adhesives, latching mechanisms, etc.

The audio actuators 528 are arranged to impart vibration into the elevator car component 526 such that sound waves 536 will propagate from the first side 530 and into the interior 532 of the elevator car. The audio actuators 528 are electrically connected to an audio system controller 522 by a communication connection 524. The communication connection 524 can be wired or wireless, as will be appreciated by those of skill in the art. The vibration generated by the audio actuators 528 will cause the elevator car component 526 to vibrate at a predetermined frequency and/or amplitude to generate a noise in the form of sound waves 536 propagating into the interior 532 of the elevator car 503.

The audio system controller 522 may be coupled to a general elevator controller or control unit 538 and receive audio instructions therefrom. For example, the audio system controller 522 may receive information associated with actions and/or operations of the elevator car 503, including, but not limited to, opening of the elevator car doors, receiving destination input by a passengers, etc. (hereinafter "triggering events"). When a triggering event occurs, the audio system controller 522 will control one or more of the audio actuators 528 on the elevator car component 526 to cause vibration thereof and thus generate sound within the interior 532 of the elevator car 503 associated with the triggering event. For example, a triggering event may be the selection of "Floor 5" at a car operating panel. When the elevator car travels to Floor 5, the audio system controller 522 will control the audio actuators 528 to generate sound announcing "Floor 5." A subsequent triggering event may be an announcement that the elevator car doors are opening, with, in some embodiments, an indication of which doors will be opening (e.g., in a dual entrance elevator car arrangement).

In some embodiments, the audio system controller 522 can control audio actuators that are coupled to various elevator car components around the interior 532 of the elevator car 503. Thus, certain audio actuators can be activated, while others are not, to enable orientation to a passenger, i.e., sound generation from a specific location within the interior 532 of the elevator car 503.

As noted above, the audio actuators are coupled to various elevator car components of the elevator car. Further, as noted, the different elevator car components may be formed from different materials, such as plastics, metal, wood, glass, etc. Coupling the audio actuators to the different elevator car components of different materials can enable generation of different sounds to generate desired sound production (e.g., "color of sound"). For example, certain materials may be used to generate "human voice" simulation to provide a spoken word sound. Other materials may be used for deep or high pitched sounds, such as for auditory indicators for doors opening or a floor being arrived at, or for alarms or other notifications within the interior of the elevator car.

The audio actuators of the present disclosure, in some embodiments, are substantially similar to speakers, but do not generate sounds directly. That is, the audio actuators generate vibrations which are imparted into an associated elevator car component to generate a noise therefrom. Accordingly, in some embodiments, typical speakers of an elevator system can be eliminated and all sound can be generated or produced by structural sound-generation systems of the present disclosure. In other embodiments, typical speakers can be employed for certain auditory functions and the structural sound-generation systems can be provided for different auditory functions. For example, announcements and other indications can be generated by structural sound-generation systems of the present disclosure and music can be produced from speakers.

The structural sound-generation systems of the present disclosure may require commissioning and tuning to ensure that desired auditory sound generation will be produced within the interior of the elevator car. During the commissioning process of the structural sound-generation systems of the present disclosure, a spectral analysis device can be placed in one or more prescribed locations in the interior of the elevator car. A series of predefined tones or other appropriate signals will be instructed from an audio system controller such that different audio actuators will be activated. Thus, the various elevator car components of the structural sound-generation systems of the present disclosure can be activated to generate sounds within the interior of the elevator car.

The generated sounds or response will be measured at the spectral analysis device. A series of measurements will then be obtained at the spectral analysis device. The audio system controller may be operably connected to or in communication with the spectral analysis device to enable automatic tuning and/or adjustment of the audio actuators for the actual sound transfer function of the elevator car. That is, during a commissioning operation, the elevator car can be moved within an elevator shaft, and the elevator doors can be opened and closed. Such operation will generate system noise (e.g., roping, machine, door operation, etc.) which can be accounted for by the spectral analysis device and the audio system controller. As will be appreciated by those of skill in the art, in some embodiments, the spectral analysis device may be a device such as a smart phone or other device with a microphone and a processor.

Further, the commissioning operation can be sued to identify if the audio actuators are properly installed and functioning. For example, if one or more audio actuators are not installed properly or are positioned in the wrong location, a transfer function to the spectral analyzer can be determined to be "out of normal range," and directions can be provided to fix the installation. That is, the commissioning can determine if something is not functioning properly and further provide instructions to correct the identified issue.

Advantageously, embodiments provided herein are directed to improved audio and sound generation systems for elevators. For example, embodiments described herein provide for sound generation from elevator car components of the elevator car itself, rather than relying upon speakers that are positioned and installed within or to the elevator car. Further, advantageously, embodiments of the present disclosure enable a relatively quick and easy method of adjusting/commissioning an immersive sound experience system within the elevator car.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car moveable within an elevator shaft, the elevator car having a first elevator car component, the first elevator car component having a first side facing an interior of the elevator car and a second side opposite from the first side; and a structural sound-generation system comprising:

at least one audio actuator coupled to the second side of the first elevator car component; and an audio system controller in communication with the at least one audio actuator, wherein the structural sound-generation system is configured to generate vibrations within the first elevator car component such that sound waves are produced therefrom and projected into the interior of the elevator car;

a second elevator car component having a respective first side facing the interior of the elevator car and a respective second side opposite from the first side of the second elevator car component; and the structural sound-generation system includes at least one second audio actuator coupled to the second elevator car component and arranged to generate vibrations within the second elevator car component such that sound waves are produced therefrom and projected into the interior of the elevator car, wherein the first elevator car component and the second elevator car component are made of different materials selected to generate different sounds.

2. The elevator system of claim 1, wherein the first elevator car component is one of an elevator car wall panel, an elevator car frame element, an elevator car support element, an elevator ceiling panel, an elevator floor panel, an elevator car operating panel, or an elevator car door.

3. The elevator system of claim 1, wherein the at least one audio actuator coupled to the second side of the first elevator car component comprises a plurality of audio actuators.

4. The elevator system of claim 1, wherein the first elevator car component is composed of plastic, metal, glass, or wood.

5. The elevator system of claim 1, wherein the audio system controller controls the at least one audio actuator to generate sound within the interior of the elevator car in response to a triggering event.

6. The elevator system of claim 5, wherein the triggering event is at least one of an opening of elevator car doors, destination input by a passenger at a car operating panel, arrival at a destination floor, or an emergency announcement.

7. The elevator system of claim 1, further comprising an elevator controller wherein the audio system controller is in communication with the elevator controller to receive information therefrom.

8. The elevator system of claim 1, further comprising a spectral analysis device located within the interior of the elevator car and configured to enable tuning of the structural sound-generation system.

9. The elevator system of claim 1, wherein the structural sound-generation system comprises a plurality of audio actuators arranged around the elevator car.

10. The elevator system of claim 9, wherein the audio system controller controls the plurality of audio actuators to generate sounds at specific locations within the interior of the elevator car by controlling vibration from the plurality of audio actuators to a plurality of different elevator car components.

* * * * *